US005971236A

United States Patent [19]

DesForges et al.

[11] Patent Number: 5,971,236

[45] Date of Patent: Oct. 26, 1999

[54] PROTECTIVE BRA CAGE DEVICE FOR PROTECTING A BRASSIERE IN A WASHING MACHINE

[75] Inventors: Meryl J. DesForges; Robin A. Blench, both of Escondido, Calif.

[73] Assignee: The Bravo Company, L.L.C., Escondido, Calif.

[21] Appl. No.: 09/262,714

[22] Filed: Mar. 4, 1999

[51] Int. Cl.[6] ..... D06C 15/00; D06F 35/00

[52] U.S. Cl. ..... 223/84; 223/66; 223/1

[58] Field of Search ..... 223/84, 57, 66, 223/1; 450/41–55; 206/278, 292; 248/275

[56] References Cited

U.S. PATENT DOCUMENTS

| | | | |
|---|---|---|---|
| 2,190,807 | 2/1940 | Steinberger | 223/57 |
| 2,490,508 | 12/1949 | Delgatto . | |
| 2,755,004 | 7/1956 | Schumacher . | |
| 2,815,157 | 12/1957 | Badgley . | |
| 2,951,621 | 9/1960 | Cheney . | |
| 3,085,723 | 4/1963 | Vanderburg . | |
| 3,346,149 | 10/1967 | Tiss . | |
| 3,769,819 | 11/1973 | Contreras . | |
| 4,063,637 | 12/1977 | Danforth | 206/8 |
| 5,074,410 | 12/1991 | Fries et al. . | |
| 5,172,837 | 12/1992 | Finney, Jr. et al. . | |
| 5,211,191 | 5/1993 | Brown . | |
| 5,556,013 | 9/1996 | Mayer . | |
| 5,611,441 | 3/1997 | Bartko . | |

*Primary Examiner*—Bibhu Mohanty
*Attorney, Agent, or Firm*—Loyal McKinley Hanson

[57] ABSTRACT

A device for protecting a brassiere in a washing machine includes a pair of hemispherically shaped shells (preferably injection molded polypropylene material) adapted to assemble together over a cup of the brassiere as a protective covering for the cup. The outer shell has a circularly shaped first rim portion and a hemispherically shaped first dome portion larger than the cup of the brassiere that extends to the first rim portion. The inner shell has a circularly shaped second rim portion and a hemispherically shaped second dome portion that extends to the second rim portion, said second dome portion having a size adapted to fit within the first dome portion of the outer shell with the first and second rim portions in concentric relationship and the cup of the brassiere disposed intermediate the first and second dome portions. At least three pins are included on the second rim portion of the inner shell and at least three pin-engaging structures are provided on the outer shell for engaging the pins in order to removably secure the inner shell to the outer shell with the cup of the brassiere in between. Each pin-engaging structure preferably defines a slot adapted to receive a pin in multiple pin positions with a friction fit sufficient to engage the pin.

7 Claims, 3 Drawing Sheets

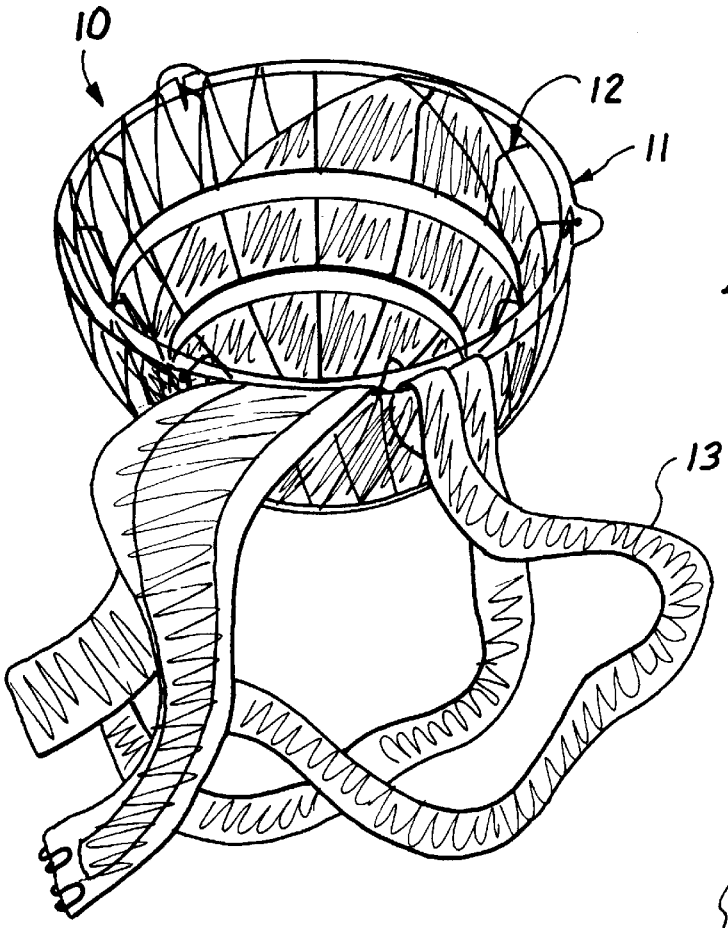
Fig. 1
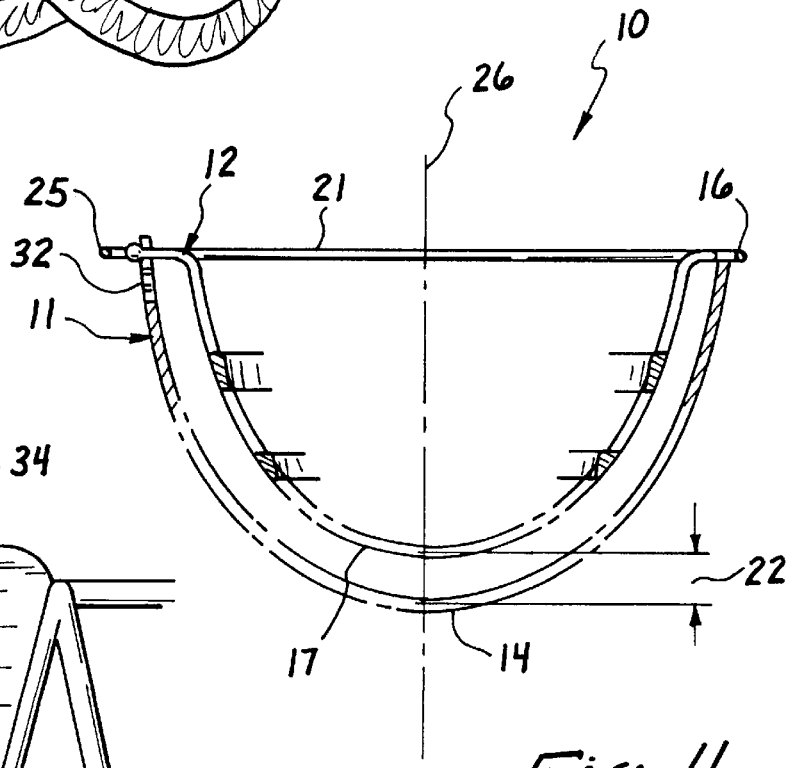
Fig. 4
Fig. 5
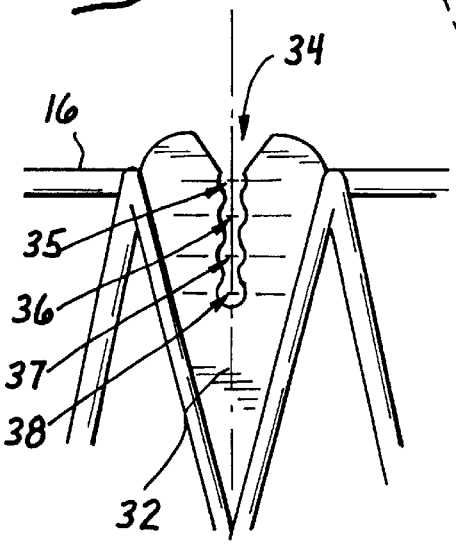

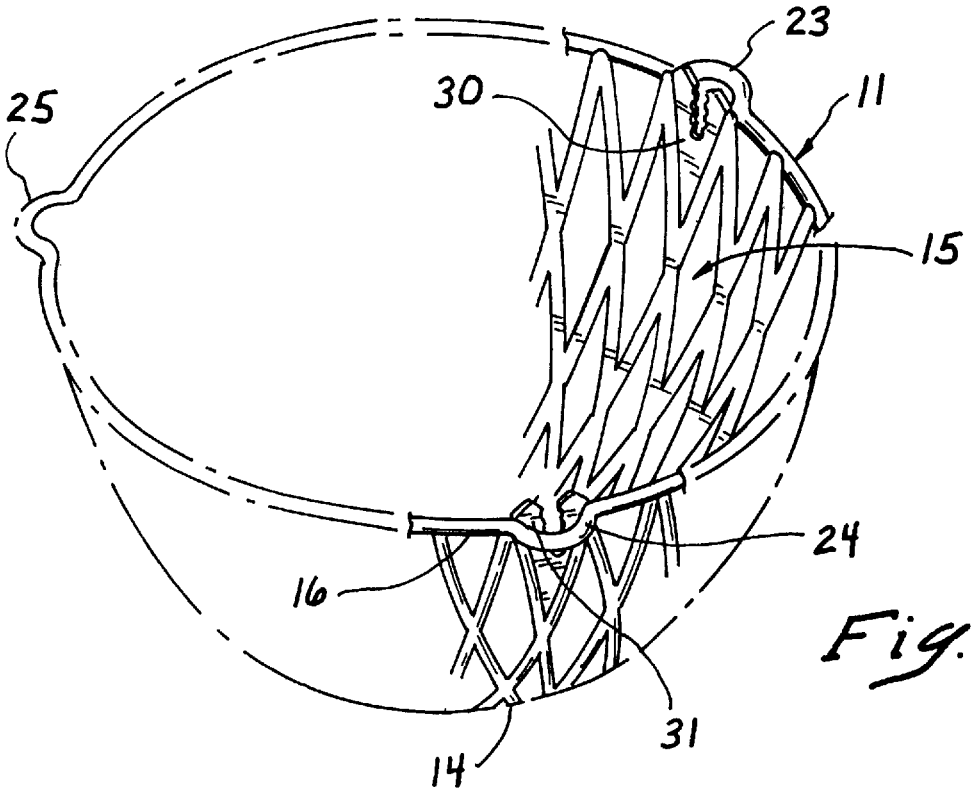
Fig. 2
Fig. 3
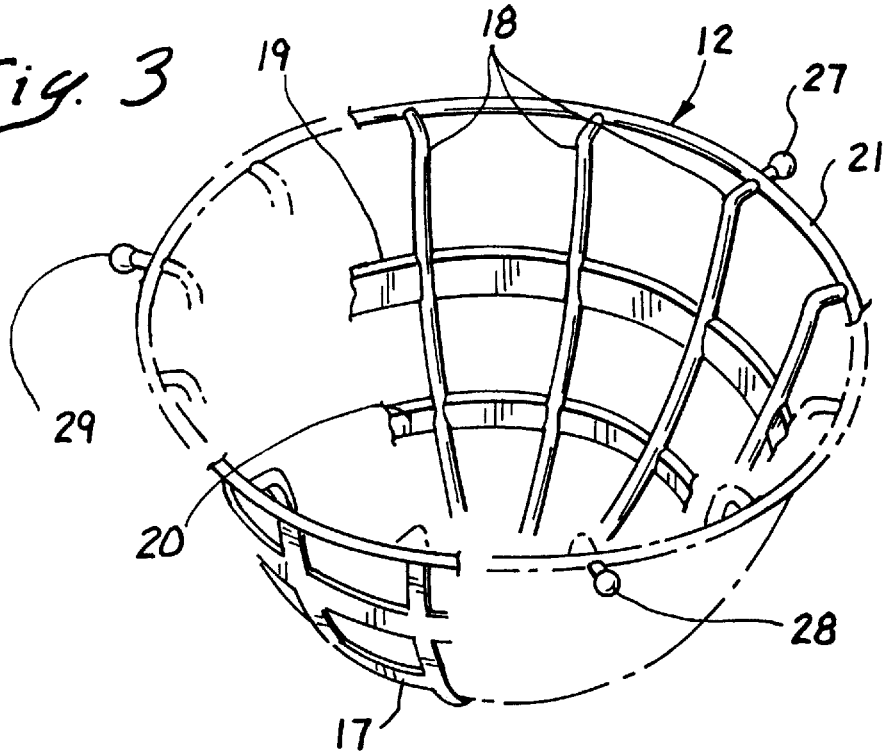

PROTECTIVE BRA CAGE DEVICE FOR PROTECTING A BRASSIERE IN A WASHING MACHINE

BACKGROUND OF THE INVENTION

1. Technical Field

This invention relates generally to brassieres, and more particularly to a protective bra cage device for protecting a brassiere during laundering in a washing machine.

2. Description of Related Art

Machine washing can easily damage a delicate brassiere. The garment protector of U.S. Pat. No. 5,556,013 alleviates that concern by using two domed-shaped basket members to hold the cups of the bra during laundering. After securing the cups tightly in the basket members with two hinged biasing members, the user rotates the basket members into a football-like configuration, locks them together, and proceeds to machine wash and dry the entire assembly.

Protecting the bra that way can help maintain the proper configuration of the cups without damage throughout the entire laundry cycle. But certain drawbacks exist. The hinged biasing members, for example, can put too much pressure on a delicate cup. In addition, they may not adequately adjust to and carefully hold various different bras, including sweater and pushup bras having different thicknesses of soft foam padding. Furthermore, the hinged biasing can introduce fabrication expense that might be avoided. Thus, consumers seek an improved device for protecting a bra during machine washing that is easier and less costly to fabricate while working better and lasting longer.

SUMMARY OF THE INVENTION

This invention addresses the problems outlined above by providing a protective bra cage device having separate inner and outer hemispherically shaped shells that snap together in spaced-apart relationship with the bra cup held between them. Pressure against the bra is more easily controlled. No failure-prone hinge holds them together. They are easier and less costly to fabricate. One bra cage device can receive both cups of a bra or be used with a second device.

To paraphrase some of the more precise language appearing in the claims, a protective bra cage device constructed according to the invention includes a pair of hemispherically shaped shells (preferably injection molded polypropylene material) adapted to assemble together over a cup of the brassiere as a protective covering for the cup. The outer shell has a circularly shaped first rim portion and a hemispherically shaped first dome portion larger than the cup of the brassiere that extends to the first rim portion. The inner shell has a circularly shaped second rim portion and a hemispherically shaped second dome portion that extends to the second rim portion, said second dome portion having a size adapted to fit within the first dome portion of the outer shell with the first and second rim portions in concentric relationship and the cup of the brassiere disposed intermediate the first and second dome portions.

At least three pins (i.e., posts or protrusions) are included on the second rim portion of the inner shell and at least three pin-engaging structures are provided on the outer shell for engaging the pins in order to removably secure the inner shell to the outer shell with the cup of the brassiere in between. Each pin-engaging structure preferably defines a slot adapted to receive a pin in a user selected one of multiple pin positions with a friction fit sufficient to engage the pin. So configured, the device is easier and less costly to fabricate while working better and lasting longer. The following illustrative drawings and detailed description make the foregoing and other objects, features, and advantages of the invention more apparent.

BRIEF DESCRIPTION OF THE DRAWINGS

FIG. 1 of the drawings is a perspective view of a protective bra cage device constructed according to the invention, with the inner and outer shells assembled over a brassiere;

FIG. 2 is an enlarged perspective view of just the outer shell, with portions of the repetitive diamond pattern omitted design of the rib and ring elements omitted for illustrative convenience;

FIG. 3 is an enlarged perspective view of just the inner shell, with portions of the repetitive pattern of the rib and ring elements omitted for illustrative convenience;

FIG. 4 is a cross sectional view of the assembled inner and outer shells taken in a vertical plane with the brassiere omitted;

FIG. 5 is a further enlarged detail view of one of the three pin-engaging structures on the outer shell;

DESCRIPTION OF A PREFERRED EMBODIMENT

Figure 6:
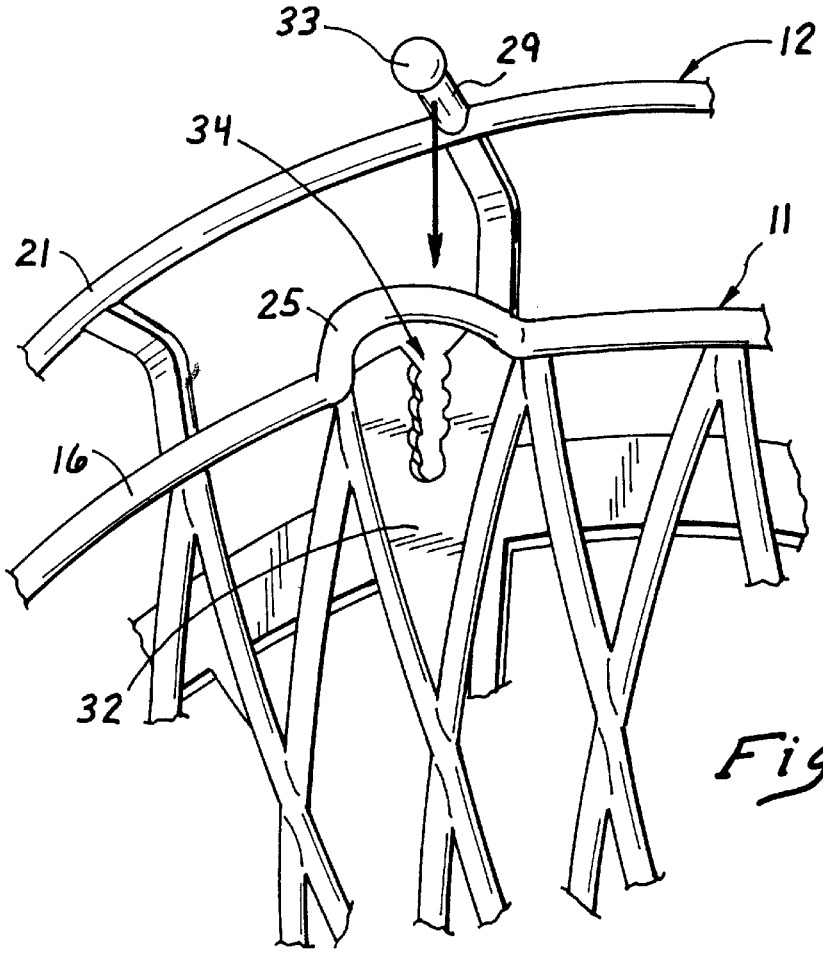
FIG. 6 is an enlarged view showing one of the three pins of the inner shell in position for placement into the corresponding pin-engaging structure on the outer shell.

FIGS. 1–7 show various aspects of a protective bra cage device 10 constructed according to the invention. Generally, the device 10 includes a pair of hemispherically shaped shells 11 and 12. They are referred to as an outer shell 11 (i.e., a first or outer cage member) and an inner shell 12 (i.e., a second or inner cage member), and they may be described more specifically as ellipsoid segments. Broadly speaking, however, they are domed or cup shaped so that they can be assembled together over a bra 13 (FIG. 1) for purposes of protecting the bra 13 during machine washing.

The bra 13 represents a conventional brassiere. It is a woman's close-fitting undergarment with two cups for bust support. The cups are stacked together (one cup cradling the other) before assembling the device 10 over them as suggested by FIG. 1. The cups of the bra 13 are then held between the outer and inner shells 11 and 12. Bra straps may also be held within the device 10, although they are left exposed in FIG. 1 for illustrative purposes. Of course, two separate protective bra cage devices may be used instead, one for each cup of the bra 13, without departing from the inventive concepts disclosed.

FIG. 2 is an enlarged view of just the outer shell 12. It is composed of a polypropylene material that is injection molded into the illustrated configuration. It includes a hemispherically shaped dome portion (a first dome portion 14) with structure that forms a pattern of diamond shaped openings (e.g., opening 15 in FIG. 2). This mesh helps protect fine, delicate fabrics and lace. The first dome portion 14 has a size larger than a cup of the bra 13 so that the cup can be placed within the first dome portion 14 as illustrated in FIG. 1, and the first dome portion 14 extends to a circular first rim portion 16 of the outer shell 12.

FIG. 3 is an enlarged view of just the inner shell 13. It is also composed of a polypropylene material that is injection molded into the illustrated configuration. It includes a hemispherically shaped second dome portion 17 formed with rib dome elements 18 and ring dome elements 19 and 20 disposed as illustrated, just three of the rib dome elements 18 being designated in FIG. 3. The second dome portion 17 extends to a second rim portion 21 of the inner shell 13 and it has a size adapted to fit within the first dome portion 14 of the outer shell 11 with the first and second rim portions 16 and 21 in concentric relationship as depicted in FIG. 1. The fit is such that there is sufficient space between the first and second dome portions 14 and 17 (e.g., 0.5 inch) to accommodate the cup of the bra 13 between the dome portions. That space is designated with a reference numeral 22 in FIG. 4.

Figure 7:
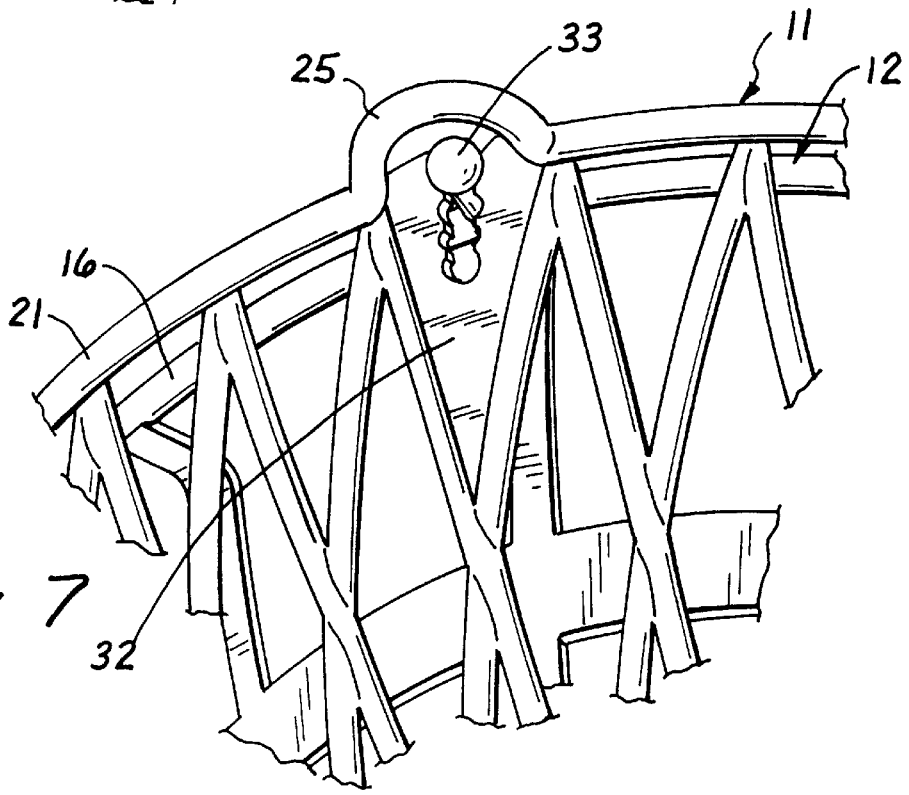
FIG. 7 is an enlarged view similar to FIG. 6 showing the pin held by the post-engaging structure in the first of four pin positions.

As a further idea of size, the first rim portion 16 of the outer shell is about 0.125 inch thick and it extends along a circular path along most of its length of about 6.0 inches in diameter, apart from the three bulges 23, 24, and 25 (FIG. 2) that provide space for locking mechanisms discussed further on in this description with reference to FIGS. 5, 6, and 7. The second rim portion 21 of the inner shell 12 is also about 0.125 inch thick and it extends along a circular path or about 5.625 inches in diameter. That dimensioning allows the second rim portion 21 to fit concentrically within the first rim portion 16 when the outer and inner shells 11 and 12 are assembled. When so assembled, the hemispherical shapes of the first and second dome portions 14 and 17 are symmetrically disposed about a central axis 26 in FIG. 4. Of course, other rounded hemispherical shapes may be employed without departing from the scope of the claims.

In order to hold the two shells 11 and 12 together, the inner shell 12 includes at least three pins 27, 28 and 29 (i.e., protrusions or posts) that protrude radially outwardly from the second rim portion 21 at uniform 120-degree intervals (FIG. 3), and the outer shell 11 includes at least three pin-engaging structures 30, 31, and 32 disposed at uniform 120-degree intervals adjacent the bulges 23, 24, and 25 in the first rim portion 16 (FIG. 2). Only the two pin-engaging structures 30 and 31 are illustrated in FIG. 2, but the pin-engaging structure 32 is shown in FIG. 4. When the user assembles the inner and outer shells 11 and 12 into the configuration shown in FIG. 4, the three pin-engaging structures 28 removably engage the three pins 27 and that holds the two shells together.

The three pins 27, 28, and 29 are similar and so only the pin 29 is described in further detail. Preferably, it is injection molded as an integral part of the inner shell 12 in one-piece construction. It measures about 0.125 inch in diameter, extends radially outwardly about 0.6 inch from the second rim portion 21, and includes a 3/16-inch diameter spherically shaped enlargement or knob 33 at the outermost end.

The three pin-engaging structures 30, 31, and 32 are also similar and so only the pin-engaging structure 32 is described in further detail. It is injection molded as an integral part of the outer shell 11 in one-piece construction. It defines a slot 34 (FIG. 5) that is 0.090 inch in width at its narrower regions and about 0.120 inch wide at each of four circular reliefs 35, 36, 37, and 38 that are spaced apart on 0.125-inch centers.

To assemble the shells 11 and 12, the user moves the pin 29 toward the slot 34 as depicted in FIG. 6. Then, as the user forces the pin 29 into the slot 34, the pin-engaging structure 32 resiliently deforms slightly to receive and engage the pin 29 in a force fit while the knob 33 keeps the pin from sliding out of the slot 34 (radially relative to the circular first rim portion 16). The four reliefs 35–38 designated in FIG. 5 define four pin positions. The user pushes the pin 29 to the desired one of those four pin positions in order to adjust the spacing between the shells 11 and 12 designated by the reference numeral 22 in FIG. 4. That feature enables the user to adjust the pressure the inner shell 12 applies to the bra 13 when the bra 13 is held between the two shells 11 and 12. FIG. 7 shows the pin 29 in the first pin position defined by the relief 35. The user simply pulls the two shells 11 and 12 apart to disassemble them.

Thus, the invention provides a protective bra cage device having separate inner and outer hemispherically shaped shells that snap together in spaced-apart relationship with the bra cup held between them. Pressure against the bra is more easily controlled. No failure-prone hinge holds them together. The device is easier and less costly to fabricate. One bra cage device can receive both cups of a bra or be used with a second device.

Although an exemplary embodiment has been shown and described, one of ordinary skill in the art may make many changes, modifications, and substitutions without necessarily departing from the spirit and scope of the invention. The term "hemispherically shaped" and derivatives thereof, for example, are intended to mean a rounded shape suitable for holding the cup of a bra and such a shape can be somewhat different than an exact one-half portion of a perfect sphere. Thus, it is intended that the meaning of the term "hemispherically shaped" be such as to include elliptically shaped, parabolically shaped, and any other dome shaped and/or cup shaped configurations, and it is intended that the claims be broadly interpreted in that regard so that any of such variously shaped shells and domed portions fall within the scope of the claims.

What is claimed is:

1. A device for protecting a brassiere in a washing machine, comprising:

a pair of hemispherically shaped shells adapted to assemble together over a cup of the brassiere as a protective covering for the cup;

an outer shell of the pair of hemispherically shaped shells, the outer shell having a circularly shaped first rim portion and a hemispherically shaped first dome portion that extends to the first rim portion, said first dome portion having a size larger than the cup of the brassiere;

an inner shell of the pair of hemispherically shaped shells, the inner shell having a circularly shaped second rim portion and a hemispherically shaped second dome portion that extends to the second rim portion, said second dome portion having a size adapted to fit within the first dome portion of the outer shell with the first and second rim portions in concentric relationship and the cup of the brassiere disposed intermediate the first and second dome portions;

at least three pins on the inner shell that protrude radially outwardly from the second rim portion at circumferentially spaced apart locations; and means on the outer shell for engaging the pins in order to removably secure the inner shell to the outer shell with the cup of the brassiere in between, said means including at least three pin-engaging structures on the outer shell at circumferentially spaced apart locations along the first rim portion that are each adapted to removably engage one of the pins when a user assembles the inner and outer shells over the cup.

2. A device as recited in claim 1, wherein at least one of the first and second shells is composed of an injection molded polypropylene material.

3. A device as recited in claim 1, wherein at least one of the pin-engaging structures defines a slot adapted to receive a pin with a friction fit sufficient to engage the pin.

4. A device as recited in claim 1, wherein at least one of the pin-engaging structures defines a slot adapted to receive a pin with a friction fit sufficient to engage the pin, and the slot includes multiple reliefs that define multiple pin positions the user can select from in order to selectively vary pressure of the inner shell against the cup of the brassiere.

5. A device as recited in claim 1, wherein the first dome portion of the outer shell includes elements arranged in a diamond mesh pattern.

6. A device as recited in claim 1, wherein the second dome portion of the inner shell includes a pattern of ring elements supported by rib elements.

7. A device for protecting a brassiere, comprising:

a pair of hemispherically shaped shells that are composed of an injection molded polypropylene material and adapted to assemble together over a cup of the brassiere as a protective covering for the cup;

an outer shell of the pair of hemispherically shaped shells, the outer shell having a circularly shaped first rim portion and a hemispherically shaped first dome portion that extends to the first rim portion, said first dome portion having a size larger than the cup of the brassiere;

an inner shell of the pair of hemispherically shaped shells, the inner shell having a circularly shaped second rim portion and a hemispherically shaped second dome portion that extends to the second rim portion, said second dome portion having a size adapted to fit within the first dome portion of the outer shell with the first and second rim portions in concentric relationship and the cup of the brassiere disposed intermediate the first and second dome portions;

three pins on the inner shell that extend radially outwardly from the second rim portion at circumferentially spaced apart locations; and means on the outer shell for engaging the pins in order to removably secure the inner shell to the outer shell with the cup of the brassiere in between, said means including three pin-engaging structures on the outer shell at circumferentially spaced apart locations along the first rim portion that are each adapted to removably engage one of the three pins when a user assembles the inner and outer shells over the cup, each of the pin-engaging structures defining a slot adapted to receive a post in a user selected one of multiple pin positions with a friction fit sufficient to engage the post.

* * * * *